US009771238B2

(12) United States Patent
Moore

(10) Patent No.: US 9,771,238 B2
(45) Date of Patent: Sep. 26, 2017

(54) COIL PACKAGE PAYOUT TUBE ASSEMBLY

(71) Applicant: REELEX Packaging Solutions, Inc., Patterson, NY (US)

(72) Inventor: Brian Moore, Newburgh, NY (US)

(73) Assignee: REELEX PACKAGING SOLUTIONS, INC., Patterson, NY (US)

( * ) Notice: Subject to any disclaimer, the term of this patent is extended or adjusted under 35 U.S.C. 154(b) by 234 days.

(21) Appl. No.: 14/826,582

(22) Filed: Aug. 14, 2015

(65) Prior Publication Data

US 2017/0043974 A1 Feb. 16, 2017

(51) Int. Cl.

| | |
|---|---|
| ***B65H 55/04*** | (2006.01) |
| ***B65H 57/18*** | (2006.01) |
| ***B65H 49/08*** | (2006.01) |
| ***B65H 57/12*** | (2006.01) |
| ***B65D 85/04*** | (2006.01) |

(52) U.S. Cl.

CPC ..... *B65H 55/046* (2013.01); *B65D 85/04* (2013.01); *B65H 49/08* (2013.01); *B65H 57/12* (2013.01); *B65H 57/18* (2013.01)

(58) Field of Classification Search

CPC ..... B65H 49/08; B65H 55/046; B65H 57/12; B65H 57/18; B65D 85/04

IPC ..... B65D 85/04

See application file for complete search history.

(56) References Cited

U.S. PATENT DOCUMENTS

| | | | |
|---|---|---|---|
| 2,634,922 | A | 4/1953 | Taylor, Jr. |
| 4,022,399 | A | 5/1977 | Zajac |
| 4,057,203 | A | 11/1977 | Newman et al. |
| 4,057,204 | A | 11/1977 | Zajac |
| 4,160,533 | A | 7/1979 | Kotzur et al. |
| 5,042,739 | A | 8/1991 | Zajac |
| 5,810,272 | A | 9/1998 | Wallace et al. |
| 5,979,812 | A | 11/1999 | Kotzur et al. |
| 6,086,012 | A | 7/2000 | Kotzur et al. |
| 6,109,554 | A | 8/2000 | Kotzur et al. |
| 6,341,741 | B1 | 1/2002 | Kotzur et al. |
| 6,491,163 | B1 | 12/2002 | Grcic et al. |
| 8,944,358 | B2 | 2/2015 | Copp et al. |

*Primary Examiner* — William E Dondero

(74) *Attorney, Agent, or Firm* — Gordon & Jacobson, P.C.

(57) ABSTRACT

A payout tube assembly is provided for unwinding filamentary material from a wound coil of filamentary material contained in a container having a wall panel with a hole that aligns with the payout tube assembly. The payout tube assembly includes a payout tube. The assembly also includes a generally planar payout panel affixed to the payout tube. The payout panel defines a central opening through which one end of the payout tube is received. In one embodiment, the payout panel defines a first set of arcuate slits and a second set of arcuate slits extending about the axis of the payout tube, the first and second sets of arcuate slits spaced radially and circumferentially from each other. In one embodiment, the payout panel defines radial slits extending from the central opening and defining payout panel fingers that are glued to the payout tube.

22 Claims, 3 Drawing Sheets

Fig. 3b
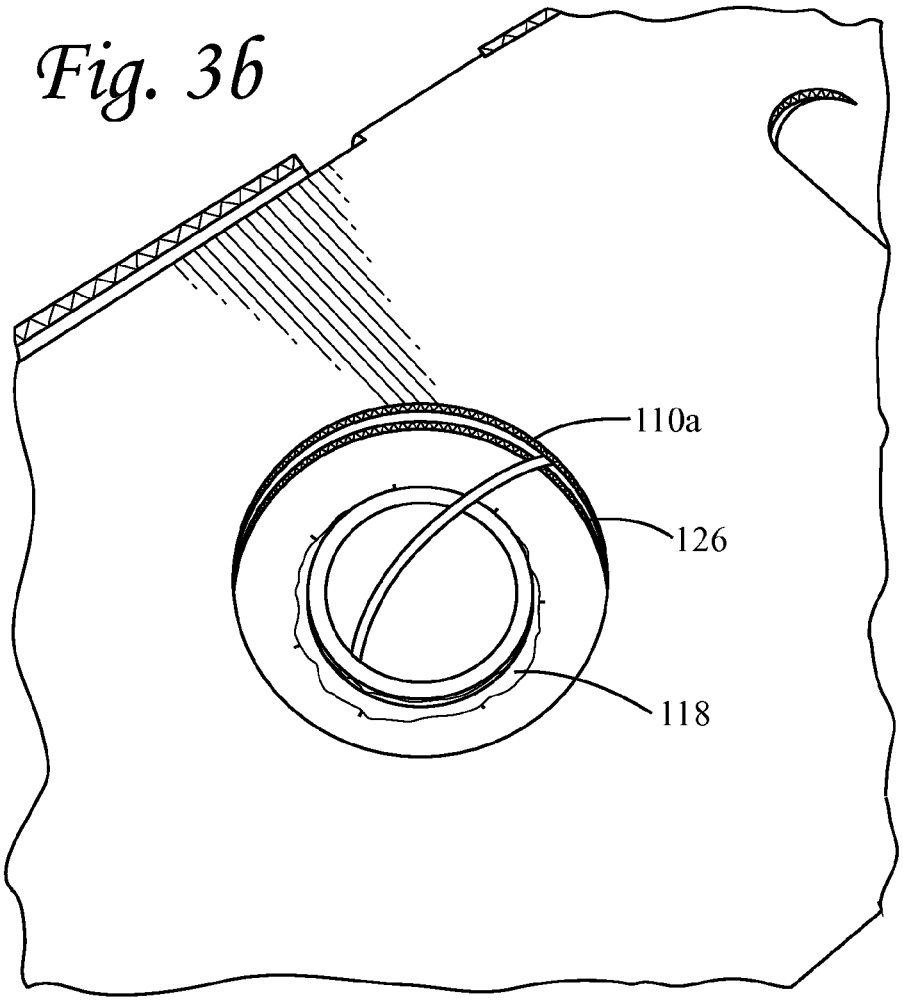
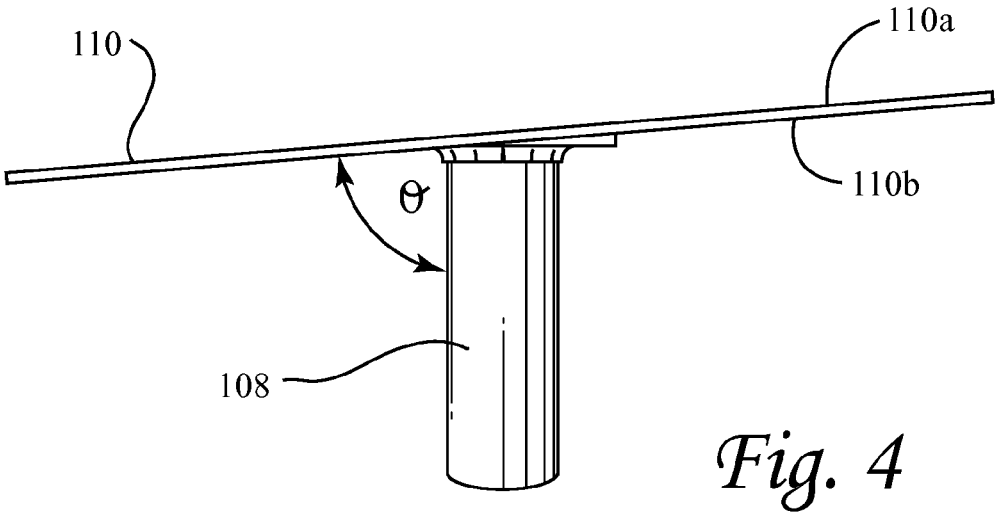
Fig. 4

COIL PACKAGE PAYOUT TUBE ASSEMBLY

BACKGROUND

1. Field

This application relates to packaging for coiled filamentary material. More particularly, this application relates to a payout tube assembly for packaging of coiled filamentary material.

2. State of the Art

U.S. Pat. No. #2,634,922 to Taylor describes the winding of flexible wire, cable or filamentary material (hereinafter "wire", which is to be broadly understood in the specification, abstract and claims) around a mandrel in a figure-eight pattern such that a package of material is obtained having a plurality of layers surrounding a central core space. By rotating the mandrel and by controllably moving a traverse that guides the wire laterally relative to mandrel, the layers of the figure-eight pattern are provided with aligned holes (cumulatively a "pay-out hole") such that the inner end of the flexible material may be drawn out through the payout hole. When a package of wire is wound in this manner, the wire may be unwound through the payout hole without rotating the package, without imparting a rotation in the wire around its axis (i.e., twisting), and without kinking. This provides a major advantage to the users of the wire. Coils that are wound in this manner and dispense from the inside-out without twists, tangles, snags or overruns are known in the art as REELEX—(a trademark of Reelex Packaging Solutions, Inc.) type coils. REELEX-type coils are wound to form a generally short hollow cylinder with a radial opening formed at one location in the middle of the cylinder. A payout tube may be located in the radial opening and the end of the wire making up the coil may be fed through the payout tube for ease in dispensing the wire. The payout tube and coil are packaged in a box and the entire package of the coiled cable has become known as a REELEX BOX.

Over the past fifty-plus years, improvements have been made to the original invention described in U.S. Pat. No. #2,634,922. Over the past fifty-plus years, an increasing number of different types of wires with different characteristics are being wound using the systems and methods described in U.S. Pat. No. 2,634,922 and the subsequent improvements. For example, the figure-eight type winding has been used for twisted-pair type cable (e.g., Category 5, Category 6 and the like), drop cable, fiber-optic cable, electrical building wire (THHN), etc.

For manually packaged REELEX BOXes, there are two basic cardboard box designs in use. One design has the coil loaded from the "square" or "square side" of the box, as shown in U.S. Pat. No. 8,944,358. That arrangement of the box is termed a "sideload" box. This coil and box arrangement is typically used with a plastic locking ring or "PLR" and a plastic payout tube to secure the payout tube to one panel in the box, such as the PLR shown in U.S. Pat. No. 5,810,272 (Wallace et al.). Typically, during assembly, the payout tube is inserted through the payout hole of the coil before the coil is introduced into the box and then the locking ring is pushed onto the payout tube from outside the box while the payout tube held steady from within the box. Thus, the PLR requires the operator to push the inside of the tube up against the PLR in order to secure it to the box.

The second basic cardboard box design for manually packaged REELEX BOXes has the coil loaded at one of the rectangular panels or "ends" of the box. That arrangement of the box is termed an "endload" or "topload" box. The topload box arrangement is typically used with a plastic or paperboard tube that has a flange, which is glued to a panel of the box, such as shown in U.S. Pat. No. 6,086,012. Owing to the glue connection of the flange of the tube to the panel of the box, a PLR is not used.

One advantage of the topload box is that the topload box construction is significantly stronger than the sideload box construction. Furthermore, the topload design allows for multiple panels to fold over each other where the coil is inserted, which means hand hold cutouts placed at these panels are particularly sturdy, as they pass through multiple panels of cardboard, as shown, for example, in U.S. Pat. No. 6,086,012. Also, recycling a topload using a paperboard payout tube is simpler than for a sideload box using a PLR, because only paperboard need be recycled instead of plastic and paperboard.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a payout tube assembly is provided and comprises a payout tube that is affixed to a payout panel. The payout panel defines a central opening through which a first end of the payout tube is received. In one embodiment, the payout panel defines a plurality of slits extending radially from the central opening and defining fingers in the panel. In manufacturing the payout tube assembly, an end of the payout tube is pushed into the central opening of the payout panel causing the fingers to engage the tube and generating a well into which glue is placed in order to affix the tube to the payout panel.

In one embodiment, in addition to the center hole, the payout panel defines a first set of arcuate slits and a second set of arcuate slits extending about the axis of the payout tube, with the first and second sets of arcuate slits being spaced radially and circumferentially from each other. In one aspect, the slits permit the payout tube a rotational range of motion with respect to the payout panel that will not cause the tube to separate from the panel. The range of motion is sufficient to compensate for any relative movement between a wound coil having a payout hole into which one end of the payout tube is inserted and a box container having an opening in which a second end of the payout tube is aligned and in which the coil is stored as discussed below.

In embodiments, both the payout tube and the payout panel are formed of at least one of paperboard and cardboard. In one embodiment, the payout panel is generally planar and rectangular and the payout tube is generally circular in cross-section.

In one embodiment, a packaging system is provided for packaging a wound coil of filamentary material. The system comprises a container in conjunction with an embodiment of a payout tube assembly such as an embodiment previously described. In one embodiment, the container comprises a cardboard box having a plurality of box (container) panels. The container is constructed to house a wound coil of filamentary material. At least one box panel defines an exit hole through which the filamentary material can be drawn out of the container. When the box and payout tube assembly of the packaging system are assembled together, the axis of the payout tube aligns with the exit hole of the box panel in order to facilitate unwinding of the filamentary material from a wound coil located inside the box.

In another embodiment, a package of coiled filamentary material is provided. The package includes a coil of filamentary material wound in a figure eight pattern and the packaging system described hereinabove into which the coil is loaded, where the payout tube of the payout tube assembly extends into a payout hole formed in the coil.

BRIEF DESCRIPTION OF THE DRAWINGS

FIG. 3*b* is a partial view of the payout tube assembly of FIG. 1, viewed through an exit opening in a panel of the box of FIG. 1.

FIG. 4 illustrates a relative rotational position between the payout tube and payout panel of the payout tube assembly of FIG. 2.

DETAILED DESCRIPTION

Figure 1:
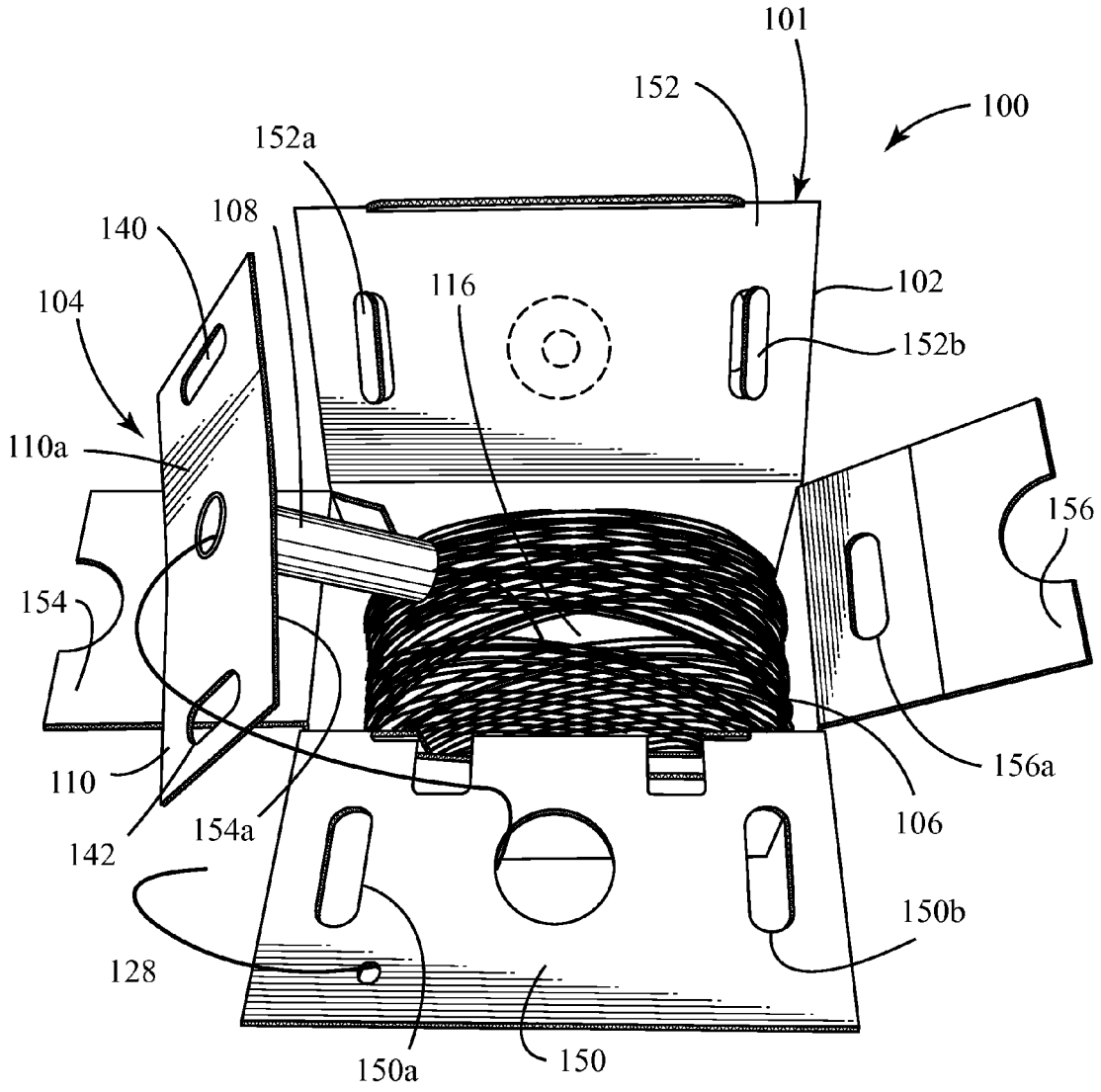
FIG. 1 illustrates an embodiment of a partially assembled package of coiled filamentary material comprised of a packaging system and a coil of filamentary material.

One embodiment of a package 100 of coiled filamentary material is illustrated in FIG. 1 and includes a coil 106 and a packaging system 101. A packaging system 101 includes a multipanel container or box 102 and a payout tube assembly 104. The multipanel box 102 is constructed to receive and house coil 106 of filamentary material, such as, for example, a REELEX-type coil. The box 102 includes four box panels 150, 152, 154, and 156 that act as flaps that can be folded open (as shown in FIG. 1) and closed to store the coil 106 and the payout tube assembly 104 inside the box 102.

The payout tube assembly 104 includes a payout tube 108 and a payout panel 110 affixed to the payout tube 108. FIG. 1 shows an outer side 110*a* of the payout panel 110. As used herein, the terms "inner" and "outer" refer to a facing orientation with respect to the coil 106 when the package 100 is assembled, as shown partially in FIG. 3*b*. The coil 106 defines a payout hole 116 that receives at least a portion of the payout tube 108. The payout tube 108 and payout panel 110 may be formed of cardboard or paperboard so that the entire packaging system 101 can be composted with the box 102 when the coil 106 has been completely consumed.

Figure 2:
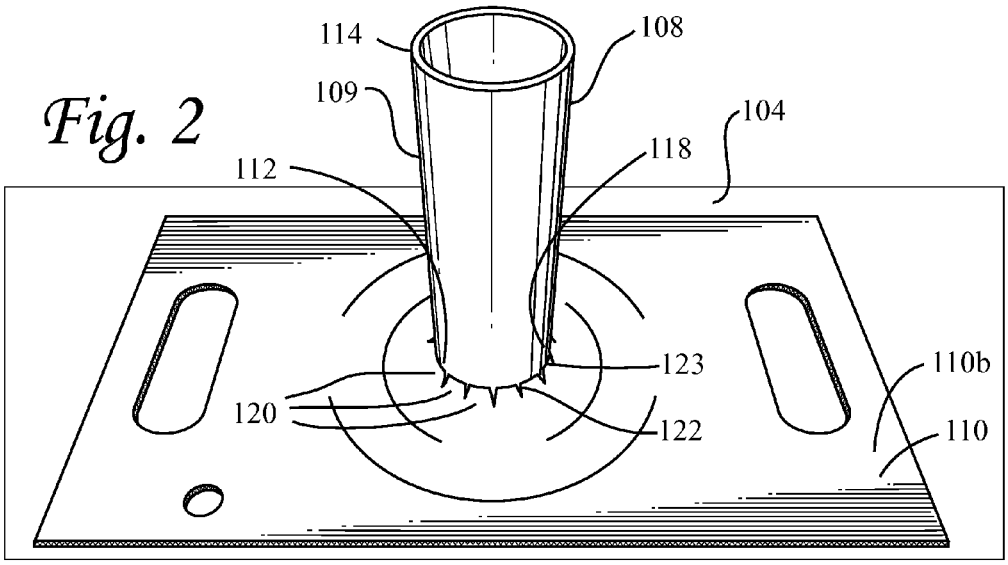
FIG. 2 is a perspective view of a payout tube assembly of FIG. 1, viewed from a side of a payout tube and an inner side of a payout panel of the payout tube assembly.

FIG. 2 shows an inner side 110*b* (opposite side 110*a* shown in FIG. 1) of the payout panel 110 and further details of the connection of the payout panel 110 to the payout tube 108. The payout tube 108 is affixed at a first end 112 to the payout panel 110 with glue, as described in greater detail below. The payout tube 108 has a second end 114, opposite the first end 112, that is constructed to be introduced into a payout hole 116 (FIG. 1) of the coil 106 through which the filamentary material is drawn during dispensing. As shown in FIG. 1, during payout of the filamentary material from the box 102, the filamentary material is drawn through the payout tube 108 from its second end 114, which is received in the payout hole 116, to its first end 112.

The payout panel 110 defines a central opening 118 in which the first end 112 of the payout tube 108 is received. A plurality of radially extending fingers 120 extend along a circular edge 123 of the payout panel 110 that borders the central opening 118. In the embodiment shown in FIG. 2, the radial fingers 120 are adjacent to one another but are separated by radially extending slits 122. The slits 122 and the fingers 120 may be equally spaced circumferentially, as shown in FIG. 2. The fingers 120 are bent toward the inner side 110*b* of the payout panel 110, generally transverse to the planar surface of the payout panel 110. The radially inner ends of the fingers 120 contact the outer surface of the payout tube 108 and thereby partially support the tube 108.

Figure 3A:
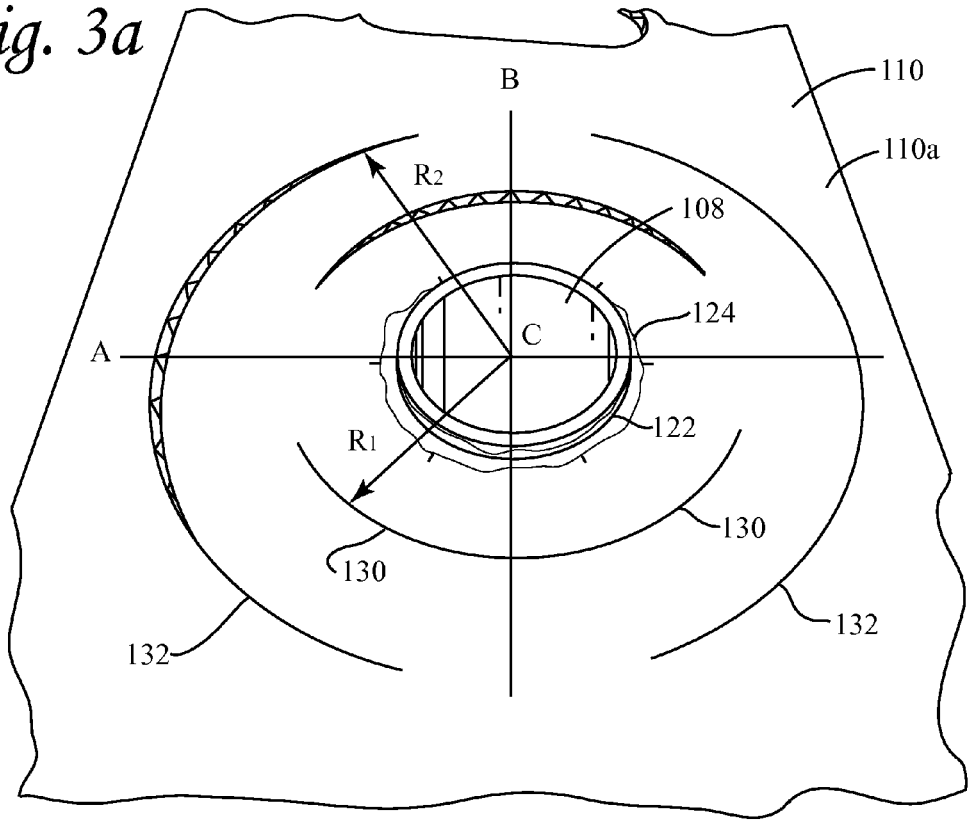
FIG. 3*a* is a partial view of the payout tube assembly of FIG. 2, viewed from an outer side of the payout panel.

FIGS. 3*a* and 3*b* show the payout tube assembly 104 from an outer side 110*a* of the payout panel 110. Owing to the inward direction of the bent fingers 120 and their curvature shown in FIG. 2, a relatively wide and deep annular glue well 122 is defined between the outer side 109 (FIG. 2) of the payout tube 108 and the fingers 120 on the outer side 110*a* of the payout panel 110. Glue 124, such as hot-melt glue or any other glue or adhesive (the term "glue" being defined broadly herein to include any adhesive or fixative), may be introduced into the annular glue well 122 so that the glue 124 can adhere to both the payout tube 108 and the payout panel 110, which reinforces the connection between the payout tube 108 and the payout panel 110. When the glue 124 is cured, the glue 124 forms a ring that can effectively lock the payout tube 108 and the payout panel 110 together, thereby mimicking the PLR arrangement of the sideload box design, but without using plastic.

In one embodiment, the glue 124 may be biodegradable or compostable hot-melt glue. Using a compostable or biodegradable hot-melt glue to adhere the payout tube 108 to the payout panel 110, in lieu of a plastic PLR, allows the entire package system 101 to be completely compostable.

One advantage of the payout tube assembly 104 is that its construction facilitates loading the coil 106 into the box 102 during packaging because the payout tube 108 can be inserted into the coil 106 and an inner end of the filamentary material 128 of the coil 106 can be pushed through the payout tube 108 prior to inserting the payout tube assembly 104 and the coil 106 into the box 102. Once the coil 106 and the payout tube assembly 104 are assembled together outside the box 102, they are loaded as an assembly into the box 102, as shown in FIG. 3*b*, so that the central opening 118 of the payout panel 110 aligns with an exit opening 126 formed in a panel of the box 102. The rectangular shape of the payout panel 110 generally matches the shape of the end opening of the box 102 through which the coil 106 is loaded, further facilitating aligning the panel 110 and the tube 108 with the exit opening 126.

As shown in FIG. 3*a*, two sets of arcuate slits 130, 132 are defined by the payout panel 110. The two sets of slits 130, 132 are radially and circumferentially offset from each other. A first set of arcuate slits 130 are formed at a first radial distance "R1" from a radial center "C" of the payout tube 108 and a second set of arcuate slits 132 are formed at a second radial distance "R2" from the radial center of the payout tube 108. Also, the first set of slits 130 is circumferentially offset from the second set of slits 132 by about ninety (90) degrees. As a result of the spacing between the sets of slits 130 and 132, a gimbaled configuration is provided around the central opening 118 of the payout panel 110 that allows the glued payout tube 108 to pivot in at least two orthogonal directions about axes "A" and "B" relative to the planar surface of the payout panel 110. For example, the first set of arcuate slits 130 provide the payout tube 108 freedom of movement about axis "A" and the second set of arcuate slits 130 provide the payout tube 108 freedom of movement about axis "B". Due to the freedom of movement of the payout tube 108, the payout tube 108 can move about either or both of the two axes A and B without transferring forces to the glued connection between the first end 112 of the payout tube 108 and the payout panel 110 that could weaken or break the glued connection.

In an undeflected position of the payout tube 108, the payout tube 108 extends generally perpendicular to the planar surface of the payout panel 110. In a deflected position of the payout tube 108, such as is shown in FIG. 4, the payout tube extends at an angle θ other than ninety degrees with respect to the planar surface of the payout panel 110. In one embodiment, the slits 130, 132 permit the payout tube 108 to angle up to twenty degrees relative to either or both of axes A and B without ripping the payout panel 110 or breaking the glue connection. In another embodiment, the slits 130, 132 permit the payout tube 108 to angle up to forty-five degrees relative to either or both of axes A and B without ripping the payout panel 110 or breaking the glue connection.

The system 101 shown in FIG. 1 is also designed for increased strength relative to prior art side- and top-load boxes, particularly around the handle areas. The payout panel 110 shown in FIG. 1 defines two elongated handle openings 140, 142 that each aligns with a respective plurality of handle openings formed in some of the panels of the box 102. For example, a first handle opening 140 of the payout panel 110 aligns with handle openings 150*a*, 152*a*, and 154*a* (obscured by the payout panel 110 in FIG. 1), respectively formed in box panels 150, 152, and 154. Also, a second handle opening 142 of the payout panel 110 aligns with handle openings 150*b*, 152*b*, and 156*a*, respectively formed in box panels 150, 152, and 156. As a result of the alignment of the handle openings 140 and 142 of the payout panel 110 and those of the box 102, the handle openings are reinforced by the overlapping panels of the box 102 and the payout panel 110, which allows for the lifting of boxes 102 containing heavier (up to 501*b*) coils 106 without risking damage to the box 102 or the panel 110.

The embodiments described above are advantageous over prior art packaging arrangements, such as the top load and side load box designs described above. For example, the connection between the payout tube 108 and the payout panel 110 is strain relieved by the gimbaled arrangement described above and the glued connection between the payout tube 108 and the payout panel 110. Therefore, even if the coil 106 moves with respect to the box 102 inside the box 102 and displaces the payout tube 108, the payout tube 108 will be able to move with the coil 106 without causing separation between the payout tube 108 and the payout panel 110, which can occur with prior art PLR designs discussed above.

Additionally, another advantage over the prior art designs is that the entire packaging system 101 may be composted completely rather than partially, as when there are plastic and cardboard components are used, such as with a cardboard box that employs a PLR. When the glue 124 between the payout tube 108 and payout panel 110 is selected from among biodegradable glues, the entire packaging system 101 can be composted.

Moreover, as noted above, the embodiments described facilitate assembly of the package 100 in comparison with the prior art designs described above. For example, for PLR designs, to secure the payout tube to the box, the operator handles the core tube from inside the box while the PLR is pushed on the tube from outside the box. On the other hand, the coil 106 and the payout tube 108 can be assembled together outside the box 102 and introduced together as an assembly into the box 102, such that additional handling of the payout tube is not needed from inside the box after the coil is loaded in the box.

Thus, it is desirable to provide a packaging system that is strong, easy to recycle, and less prone to damage due to relative movement between the package and the coil.

There have been described and illustrated herein embodiments of a payout tube assembly, a packaging system for packaging a wound coil of filamentary material, and a package of coiled filamentary material. While particular embodiments have been described, it is not intended that the invention be limited thereto, as it is intended that the invention be as broad in scope as the art will allow and that the specification be read likewise. Thus, while a particular embodiment of a payout tube assembly has been described, it will be appreciated that the payout tube assembly may take other forms. Similarly, while a particular embodiment of a payout panel has been described, it will be appreciated that the payout panel may take other forms. Further, while particular embodiments of arcuate slits have been described for providing a movement arrangement for the payout tube, it will be appreciated that other arrangements may be utilized to provide relative movement between the payout tube and the payout panel. It will therefore be appreciated by those skilled in the art that yet other modifications could be made to the provided invention without deviating from its spirit and scope as claimed. In the claims, means-plus-function clauses, if any, are intended to cover the structures described herein as performing the recited function and not only structural equivalents, but also equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A payout tube assembly for a container housing a wound coil, the assembly comprising:

a payout tube extending axially along a central axis from a first end to a second end;

a generally planar payout panel affixed to the payout tube, the payout panel defining a central opening through which the first end of the payout tube is received, the payout panel defining a first set of arcuate slits and a second set of arcuate slits extending about the axis of the payout tube, the first and second sets of arcuate slits spaced radially and circumferentially from each other.

2. The payout tube assembly of claim 1, wherein:

said first and second sets of arcuate slits are circumferentially spaced ninety degrees apart from each other.

3. The payout tube assembly of claim 2, wherein:

said first and second arcuate slits permit said payout tube to move in two orthogonal directions relative to a plane of said generally planar payout panel.

4. The payout tube assembly of claim 1, wherein:

said payout panel defines radially directed slits that define radial fingers around said payout tube opening, said fingers constructed to bend when said first end of said tube is received in said opening, and wherein an annular glue channel is formed between an outer surface of said payout tube and said fingers.

5. The payout tube assembly of claim 4, further comprising:

glue located in said annular glue channel and affixing said payout tube to said payout panel.

6. The payout tube assembly of claim 5, wherein:

said glue is biodegradable glue.

7. The payout tube assembly of claim 4, wherein:

said fingers are circumferentially adjacent to one another.

8. The payout tube assembly of claim 1, wherein:

said payout panel defines at least one handle cutout that is constructed to align with a handle cutout formed in a wall panel of the container.

9. The payout tube assembly of claim 8, wherein:

said handle cutout of said payout panel is constructed to align with handle cutouts formed respectively on a plurality of wall panels of the container.

10. A payout tube assembly for a container, the assembly comprising:

a payout tube extending axially along a central axis from a first end to a second end;

a generally planar payout panel affixed to said payout tube, said payout panel defining a central opening through which said first end of said payout tube is received, said payout panel defining a plurality of radially directed slits that define radial fingers around said payout tube opening, said fingers constructed to bend when said first end of the tube is received in said opening, and wherein a channel is formed between an outer surface of said payout tube and said fingers; and glue located in said channel and affixing said payout tube and said payout panel to each other.

11. A packaging system for packaging a wound coil of filamentary material, the system comprising:

a container comprised of a plurality of container panels, at least one container panel having an exit hole through which the filamentary material can be drawn out of said container, said container constructed to house the wound coil of filamentary material; and a payout tube assembly for unwinding the filamentary material from the wound coil, wherein said exit hole aligns with said payout tube assembly, said payout tube assembly comprising a payout tube extending axially along a central axis from a first end to a second end and a generally planar payout panel affixed to said payout tube, said payout panel defining a central opening through which said first end of said payout tube is received, said payout panel defining at least one of (i) a first set of arcuate slits and a second set of arcuate slits extending about said axis of said payout tube, said first and second sets of arcuate slits spaced radially and circumferentially from each other, and (ii) a plurality of radially directed slits that define radial fingers around said payout tube opening, said fingers constructed to bend when said first end of said tube is received in said opening, and wherein a glue channel is formed between an outer surface of said payout tube and said fingers.

12. The system of claim 11, wherein:

said first and second sets of arcuate slits are circumferentially spaced ninety degrees apart from each other.

13. The system of claim 12, wherein:

said first and second arcuate slits permit the payout tube to move in two orthogonal directions relative to the plane of the payout panel.

14. The system of claim 13, further comprising:

glue located in said glue channel and affixing said payout tube to said payout panel.

15. The system of claim 14, wherein:

in an assembled configuration, said payout tube assembly is housed with the coil inside the container and the second end of the payout tube is inserted through a payout hole formed in the coil and the first end of the payout tube is aligned with the exit hole.

16. The system of claim 15, wherein:

a range of movement of said payout tube is at least sufficient to accommodate a range of movement of the coil with respect to said panels of said container without decoupling said payout tube from said payout panel.

17. The system of claim 11, wherein:

said container panel having said exit hole defines a container panel handle cutout, and said payout panel defines a payout panel handle cutout that aligns with said container panel handle cutout.

18. The system of claim 17, wherein:

a plurality of said container panels define a respective plurality of container panel handle cutouts, said payout panel defines a payout panel handle cutout that aligns with said plurality of container panel handle cutouts to provide aligned handle cutouts.

19. The system of claim 17, wherein:

said container is constructed to house a coil having a weight of 50 lbs and be lifted from said aligned handle cutouts without damage to said aligned handle cutouts.

20. The system of claim 11, wherein:

said payout panel defines both said first set of arcuate slits and a second set of arcuate slits extending about said axis of said payout tube and said plurality of radially directed slits that define radial fingers around said payout tube opening.

21. A package of coiled filamentary material, the package comprising:

a coil of filamentary material wound in a figure eight pattern;

a container comprised of a plurality of container panels, at least one container panel having an exit hole through which said filamentary material can be drawn out of said container without rotating said coil, said container constructed to house said coil; and a payout tube assembly comprising a payout tube extending axially along a central axis from a first end to a second end and aligned with said exit hole, and a generally planar payout panel affixed to said payout tube, the payout panel defining a central opening through which said first end of the payout tube is received, said payout panel defining at least one of (i) a first set of arcuate slits and a second set of arcuate slits extending about said axis of the payout tube, said first and second sets of arcuate slits spaced radially and circumferentially from each other, and (ii) a plurality of radially directed slits that define radial fingers around said payout tube opening, said fingers constructed to bend when said first end of said tube is received in said opening, and wherein a glue channel is formed between an outer surface of said payout tube and said fingers.

22. The package of claim 21, wherein:

said payout panel defines both said first set of arcuate slits and a second set of arcuate slits extending about said axis of said payout tube and said plurality of radially directed slits that define radial fingers around said payout tube opening;

said payout tube assembly further comprises glue in said glue channel; and said first and second sets of arcuate slits are circumferentially spaced ninety degrees apart from each other and permit said payout tube to move in two orthogonal directions relative to a plane of said payout panel.

* * * * *